US009522548B2

(12) United States Patent
Nishimura

(10) Patent No.: US 9,522,548 B2
(45) Date of Patent: Dec. 20, 2016

(54) INKJET RECORDING DEVICE

(71) Applicant: KYOCERA Document Solutions Inc., Osaka (JP)

(72) Inventor: Takatoshi Nishimura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/493,654

(22) Filed: Sep. 23, 2014

(65) Prior Publication Data

US 2015/0085010 A1 Mar. 26, 2015

(30) Foreign Application Priority Data

Sep. 25, 2013 (JP) ..... 2013-198753
Sep. 25, 2013 (JP) ..... 2013-198754

(51) Int. Cl.
*B41J 11/00* (2006.01)
*G03G 15/00* (2006.01)

(52) U.S. Cl.
CPC ..... *B41J 11/0015* (2013.01); *B41J 11/0005* (2013.01); *G03G 15/6576* (2013.01)

(58) Field of Classification Search
CPC . B41J 11/0015; B41J 11/0005; G03G 15/6576
See application file for complete search history.

(56) References Cited

U.S. PATENT DOCUMENTS 5,579,693 A 12/1996 Carreira et al.
6,589,598 B2 7/2003 Ochiai et al.
8,322,843 B2 12/2012 Kachi
2002/0104479 A1 8/2002 Ochiai et al.
2006/0254735 A1* 11/2006 Ono et al. ..... 162/136
2007/0113747 A1 5/2007 Heiler et al.
2009/0231407 A1 9/2009 Kachi
2010/0220163 A1 9/2010 Ohkubo
2011/0141180 A1 6/2011 Doi et al.
2013/0249996 A1* 9/2013 Saito et al. ..... 347/21

FOREIGN PATENT DOCUMENTS

JP H08-216384 A 8/1996
JP H10-151733 A 6/1998
JP 2001-129970 A 5/2001
(Continued)

OTHER PUBLICATIONS

An Office Action issued by the Chinese Patent Office on Sep. 29, 2015, which corresponds to Japanese Patent Application No. 201410493973.3 and is related to U.S. Appl. No. 14/493,654.

*Primary Examiner* — Justin Seo
(74) *Attorney, Agent, or Firm* — Studebaker & Brackett PC

(57) ABSTRACT

An inkjet recording device includes a recording medium conveyance mechanism, a head portion, and a liquid applying section. The recording medium conveyance mechanism is configured to convey a recording medium. The head portion is configured to eject ink onto the recording medium. The liquid applying section is configured to apply liquid to the recording medium. The recording medium may have a first surface and a second surface. The head portion may eject the ink onto the first surface of the recording medium. The liquid applying section may apply the liquid to the second surface of the recording medium.

14 Claims, 10 Drawing Sheets

(56) References Cited

FOREIGN PATENT DOCUMENTS

| | | | |
|---|---|---|---|
| JP | 2001-334642 | A | 12/2001 |
| JP | 2002-143739 | A | 5/2002 |
| JP | 2005-178252 | A | 7/2005 |
| JP | 2006-082909 | A | 3/2006 |
| JP | 2006-276449 | A | 10/2006 |
| JP | 2008-120582 | A | 5/2008 |
| JP | 2008-132692 | A | 6/2008 |
| JP | 2009-220411 | A | 10/2009 |
| JP | 2010-201619 | A | 9/2010 |
| JP | 2011-037195 | A | 2/2011 |
| JP | 2011-126081 | A | 6/2011 |
| JP | 2011-201125 | A | 10/2011 |

* cited by examiner

INKJET RECORDING DEVICE

INCORPORATION BY REFERENCE

The present application claims priority under 35 U.S.C. §119 to Japanese Patent Application Nos. 2013-198753 and 2013-198754, filed Sep. 25, 2013. The contents of this application are incorporated herein by reference in their entirety.

BACKGROUND

The present disclosure relates to inkjet recording devices.

Inkjet recording devices are compact and low in cost as compared to electrographic recording devices, need no fusing device to enable reduction in power consumption, and therefore, are widely used as printers, copiers, multifunction peripherals, etc. An inkjet recording device ejects ink droplets from a plurality of nozzles provided at its nozzle head to form an image on a recording medium such as paper.

Inks used in the inkjet recording device are divided into oil inks containing an organic solvent as a main solvent and water based inks containing water as a main solvent. In response to a demand for environmental awareness, development of water based inks containing no environmentally harmful organic solvent has been promoted.

In the case using a water based ink, water may penetrate through the print surface of paper to cause fiber of the paper to swell. As a result, expansion of the print surface may become larger than that of the non-print surface of the paper. This may tend to produce a difference in extension between the print surface and the non-print surface. In other words, a difference in stress may be liable to be produced between the print surface and the non-print surface. Due to the stress difference, a phenomenon of curling or cockling may be caused that the print surface curls into a convex shape.

A technique to reduce curling has been known that decurls and smooths down the paper in a direction reverse to the curling. A certain decurling mechanism includes a hard roller and a soft roller in press contact with each other. The decurling mechanism can reduce curling in a manner that printed paper is allowed to pass between the rollers to be warped in the direction reverse to the curling direction.

SUMMARY

An inkjet recording device according to the present disclosure includes a recording medium conveyance mechanism, a head portion, and a liquid applying section. The recording medium conveyance mechanism is configured to convey a recording medium. The head portion is configured to eject the ink onto the recording medium. The liquid applying section is configured to apply the liquid to the recording medium.

DETAILED DESCRIPTION

Figure 1:
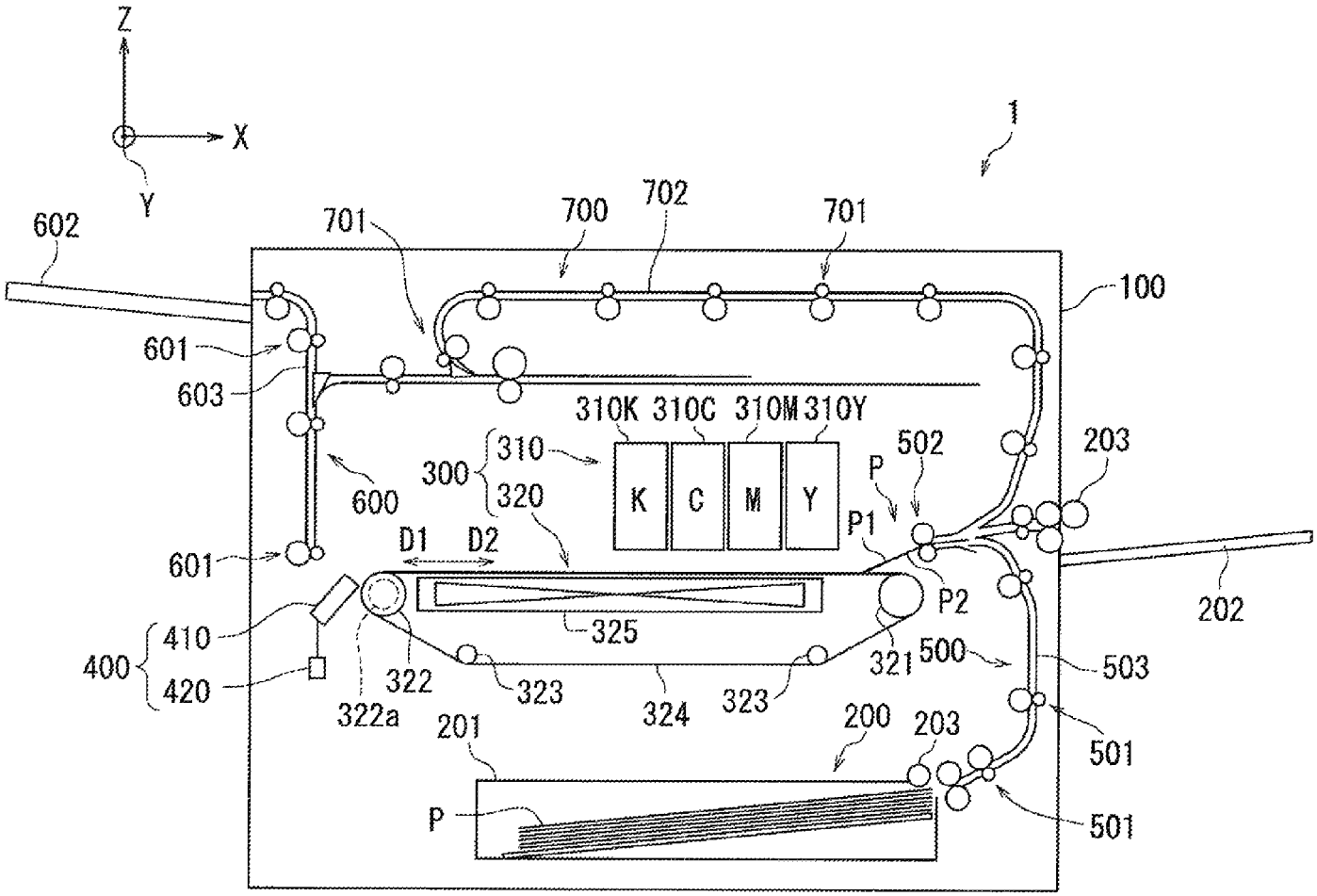
FIG. 1 is an illustration showing the configuration of an inkjet recording device according to the first embodiment of the present disclosure.

Embodiments of an inkjet recording device according to the present disclosure will be described below with reference to the accompanying drawings. It should be noted that the present disclosure is not limited to the following embodiments. It is also noted that the same reference numerals denote the same or corresponding elements in the drawings, and the description thereof will not be repeated.

First Embodiment

FIG. 1 is an illustration showing the configuration of an inkjet recording device 1 according to the first embodiment. As shown in FIG. 1, the inkjet recording device 1 includes a device casing 100, a paper feed section 200, an image forming section 300, a liquid applying section 400, a carry-in conveyance section 500, a carry-out conveyance section 600, and a reverse conveyance section 700.

The paper feed section 200 includes a paper feed cassette 201, a manual feed tray 202, and paper feed rollers 203. The paper feed cassette 201 is arranged in the lower part of the device casing 100 so as to be detachable from the device casing 100. A plurality of paper P as recording media is accommodated in a stacked state inside the paper feed cassette 201. The manual feed tray 202 is externally arranged on one side of the device casing 100. Paper P to be sent on a sheet-by-sheet basis is loaded on the manual feed tray 202. The paper feed rollers 203 are arranged above respective one end sides of the paper feed cassette 201 and the manual feed tray 202. The paper P accommodated in the paper feed cassette 201 or the paper P loaded on the manual feed tray 202 is conveyed by the corresponding one of the paper feed rollers 203 to the carry-in conveyance section 500.

The carry-in conveyance section 500 is arranged on one side of the image forming section 300. The carry-in conveyance section 500 includes a carry-in path 503 for paper P and a plurality of conveyance roller pairs 501 arranged along the carry-in path 503. The paper P conveyed from the paper feed cassette 201 or the manual feed tray 202 is conveyed by the conveyance roller pairs 501 to the image forming section 300 along the carry-in path 503. The carry-in conveyance section 500 in the first embodiment includes a registration roller pair 502 functioning as one of the conveyance roller pairs 501. The registration roller pair 502 is provided at an outlet of the carry-in path 503. The registration roller pair 502 temporarily holds the paper P and then conveys it to the image forming section 300 with print timing.

The image forming section 300 forms an image on the paper P. The image forming section 300 employs an inkjet recording scheme for image formation on the paper P. The image forming section 300 is arranged above the paper feed section 200. The image forming section 300 includes head portions 310 and a recording medium conveyance mechanism 320.

The paper P has a first surface (surface P1 shown in FIG. 1) and a second surface (surface P2 shown in FIG. 1). The recording medium conveyance mechanism 320 conveys the paper P. The head portions 310 eject ink onto the paper P. Specifically, the head portions 310 eject the ink onto the first surface of the paper P conveyed by the recording medium conveyance mechanism 320 to form an image. The image is formed on the first surface of the paper P. The first surface means a surface facing the head portions 310 when the paper P is being conveyed by the recording medium conveyance mechanism 320. The second surface means a surface in contact with the recording medium conveyance mechanism 320 when the paper P is being conveyed by the recording medium conveyance mechanism 320. The image forming section 300 in the first embodiment includes four head portions 310Y, 310M, 310C, and 310K as the head portions 310 arranged in parallel from the upstream side to the downstream side in the paper conveyance direction.

Each of the head portions 310Y, 310M, 310C, and 310K includes a plurality of nozzles (not shown) arranged in the width direction (Y direction) of the recording medium conveyance mechanism 320. The ink is ejected from the nozzles onto the first surface of the paper P. The head portions 310 are of line head type. For example, the head portions 310 of line head type are secured to the device casing 100.

The recording medium conveyance mechanism 320 includes a support roller 321, a drive roller 322, a drive section 322*a*, tension rollers 323, a conveyance belt 324, and a suction section 325.

The conveyance belt 324 is endless and wound around the support roller 321, the drive roller 322, and the tension rollers 323. The conveyance belt 324 receives the paper P from the carry-in conveyance section 500 and conveys it to the carry-out conveyance section 600. A plurality of through holes (not shown) are formed to pass through the conveyance belt 324 in the thickness direction.

The suction section 325 includes a suction device such as a fan or a vacuum pump. Driving the suction section 325 generates negative pressure. The negative pressure acts on the paper P of which one surface is supported on the conveyance belt 324 through the through holes of the conveyance belt 324, thereby sucking the paper P onto the conveyance belt 324.

The drive roller 322 is spaced apart from the support roller 321 in the paper conveyance direction. The drive section 322*a* drives to rotate the drive roller 322. The drive section 322*a* may be a motor, for example. The drive roller 322 rotates the conveyance belt 324 in a first direction (arrowed direction D1) as the paper conveyance direction and a second direction (arrowed direction D2) opposite to the first direction D1. The tension rollers 323 are arranged below and between the support roller 321 and the drive roller 322 to apply a tension to the conveyance belt 324.

The carry-out conveyance section 600 is arranged on the other side of the image forming section 300. The carry-out conveyance section 600 includes a carry-out path 603, a plurality of conveyance roller pairs 601 arranged along the carry-out path 603, and an exit tray 602. The exit tray 602 is externally arranged on the other side of the device casing 100. The conveyance roller pairs 601 convey the paper P conveyed from the recording medium conveyance mechanism 320 and subjected to simplex printing to the exit tray 602 along the carry-out path 603.

The reverse conveyance section 700 is provided for duplex printing. The reverse conveyance section 700 is arranged above the image forming section 300. The reverse conveyance section 700 includes a reverse path 702 and a plurality of conveyance roller pairs 701 arranged along the reverse path 702. In duplex printing, the paper P, on the first surface (surface P1) of which an image has been formed, is conveyed to the reverse conveyance section 700 via the carry-out conveyance section 600. The conveyance direction of the paper P conveyed to the reverse conveyance section 700 is switched in the reverse path 702. Then, the paper P is conveyed again to the recording medium conveyance mechanism 320 in a state in which its non-printed surface (surface P2) faces the head portions 310 as a first surface.

The liquid applying section 400 applies liquid to the paper P. Specifically, the liquid applying section 400 applies the liquid to the second surface of the paper P. The liquid applying section 400 in the first embodiment is arranged downstream in the paper conveyance direction of the recording medium conveyance mechanism 320. The liquid applying section 400 includes an ejection head portion 410 and a liquid amount adjusting section 420. The ejection head portion 410 ejects the liquid to apply it to the second surface of the paper P. The liquid amount adjusting section 420 adjusts the amount of the liquid that the ejection head portion 410 applies to the second surface of the paper P according to the amount of the ink ejected onto the first surface of the paper P by the head portions 310 of the image forming section 300. The liquid amount adjusting section 420 controls ejection by the ejection head portion 410 so as to increase the amount of the liquid applied onto the second surface of the paper P as the amount of the ink ejected onto the first surface of the paper P increases. The liquid amount adjusting section 420 may be a microcomputer including a CPU, a ROM, and a RAM, for example. The CPU executes adjustment of the amount of the liquid in accordance with programs stored in the ROM. The liquid that the liquid applying section 400 applies is water, for example.

The inkjet recording device 1 according to the first embodiment has been described so far with reference to FIG. 1. According to the inkjet recording device 1 in the first embodiment, the ink and the liquid are applied to the first surface (surface P1) and the second surface (surface P2) of the paper P, respectively, in simplex printing. This can cancel a stress on the first surface where the fiber absorbs the ink to swell with a stress on the second surface where the fiber absorbs the liquid to swell, thereby reducing the difference in the stress between the first and second surfaces. As a result, curling of the paper P caused due to the difference in the stress can be reduced.

By contrast, in duplex printing, the paper P is conveyed again to the image forming section 300, and the ink is applied to the first surface (herein the surface P2) of the paper P. The paper P is conveyed to the image forming section 300 in a state in which the curl is smoothed down. Accordingly, the paper P is sucked by the recording medium conveyance mechanism 320 in the image forming section 300 to be conveyed in a flat state. As a result, an image can be formed accurately on the paper P. In order to smooth down the curl in the duplex printing, the liquid may be applied onto the second surface (the surface P1 herein) of the paper P.

It is noted that the liquid amount adjusting section 420 in the first embodiment is not essential. For example, the ejection head portion 410 may eject a predetermined amount of the liquid.

Further, the liquid applying section 400 in the first embodiment applies the liquid to the paper P, which however, should not be taken to limit the present disclosure. The liquid applying section 400 may apply the liquid to the recording medium conveyance mechanism 320. For example, adjustment of the liquid ejecting direction of the ejection head portion 410 can make the liquid applying section 400 to apply the liquid to the recording medium conveyance mechanism 320. The liquid attached to the recording medium conveyance mechanism 320 is transferred to the second surface of the paper P being conveyed. Alternatively, the liquid applying section 400 may apply the liquid to both the paper P and the recording medium conveyance mechanism 320.

Second Embodiment

Figure 2:
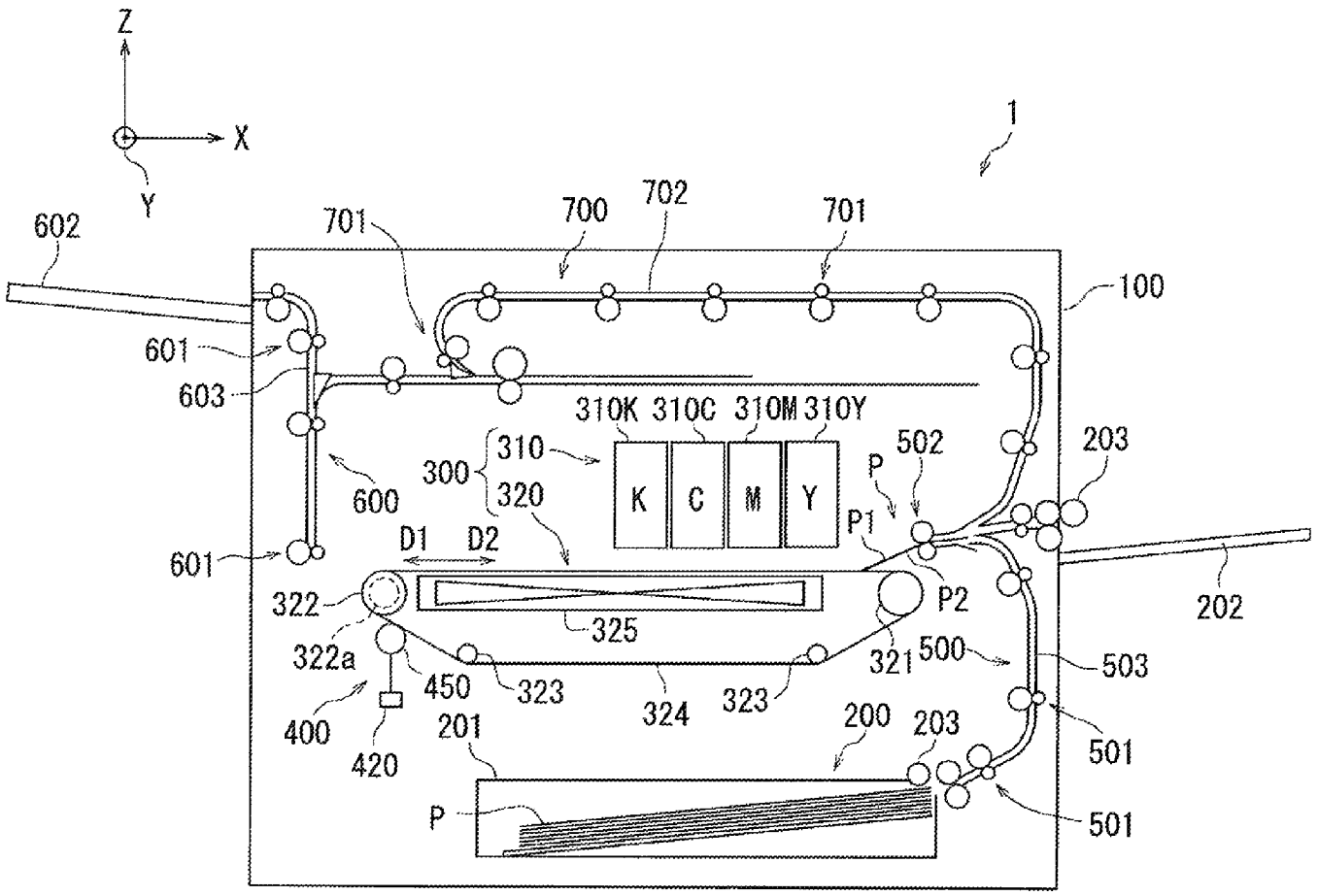
FIG. 2 is an illustration showing the configuration of an inkjet recording device according to the second embodiment of the present disclosure.

FIG. 2 is an illustration showing the configuration of an inkjet recording device 1 according to the second embodiment of the present disclosure. The inkjet recording device 1 according to the second embodiment will be described next reference to FIG. 2. The inkjet recording device 1 in the second embodiment has a configuration similar to that of the inkjet recording device 1 in the first embodiment discussed with reference to FIG. 1 except that the liquid applying section 400 is arranged in a different manner and that the liquid applying section 400 includes a liquid applying roller 450 in place of the ejection head portion 410. Therefore, duplicate description shall be omitted.

The liquid applying section 400 applies the liquid to the paper P via the recording medium conveyance mechanism 320. Specifically, the liquid applying section 400 applies the liquid to the conveyance belt 324 of the recording medium conveyance mechanism 320. In turn, the liquid is applied to the paper P. The liquid that the liquid applying section 400 applied is water, for example.

The liquid applying roller 450 is capable of separating from and coming into press contact with the conveyance belt 324 of the recording medium conveyance mechanism 320. The liquid applying roller 450 has a cylindrical outer peripheral surface, for example, to which the liquid is attached. The liquid applying roller 450 rotates while applying (coating) the liquid to the conveyance belt 324 via its contact region (nip part) in press contact with the conveyance belt 324. In image formation on the paper P, the liquid applied to the conveyance belt 324 is transferred to the second surface of the paper P being conveyed by the conveyance belt 324.

The liquid amount adjusting section 420 adjusts the amount of the liquid that the liquid applying roller 450 applies to the conveyance belt 324 according to the amount of the ink ejected onto the first surface of the paper P by the head portions 310 of the image forming section 300. Specifically, the liquid amount adjusting section 420 moves the liquid applying roller 450 toward the conveyance belt 324 so as to increase the contact area between the liquid applying roller 450 and the conveyance belt 324 as the amount of the ink ejected onto the first surface of the paper P increases. An increase in the contact area between the liquid applying roller 450 and the conveyance belt 324 can increase the amount of the liquid applied to the conveyance belt 324. The liquid amount adjusting section 420 may be a microcomputer including a CPU, a ROM, and a RAM, for example. The CPU executes adjustment of the amount of the liquid in accordance with programs stored in the ROM.

The inkjet recording device 1 according to the second embodiment has been described so far with reference to FIG. 2. According to the inkjet recording device 1 according to the second embodiment, the liquid is applied to the paper P via the recording medium conveyance mechanism 320. Accordingly, like in the first embodiment, the difference in the stress between the first and second surfaces of the paper P can be reduced, thereby preventing curling of the paper P that may be caused due to the difference in the stress in simplex printing. In duplex printing in addition, the paper P that has been smoothed down is conveyed again to the image forming section 300, thereby achieving accurate image formation on the paper P. Besides, the second embodiment can bring the same advantages as those in the first embodiment.

Figure 3:
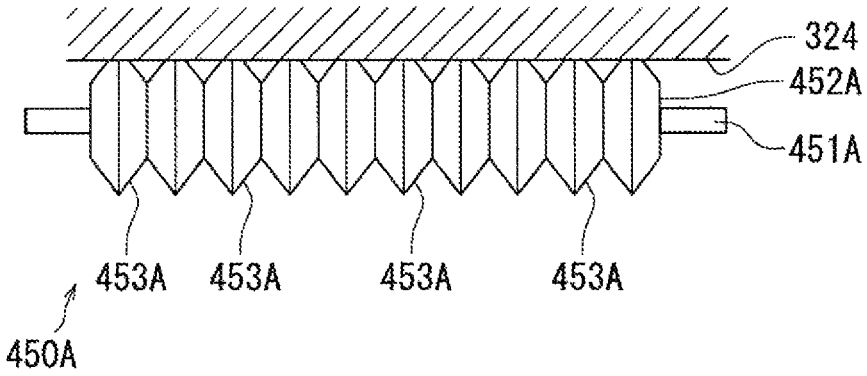
FIG. 3 is an illustration showing a liquid applying roller of an inkjet recording device according to the first variation in the second embodiment of the present disclosure.
Figure 4:
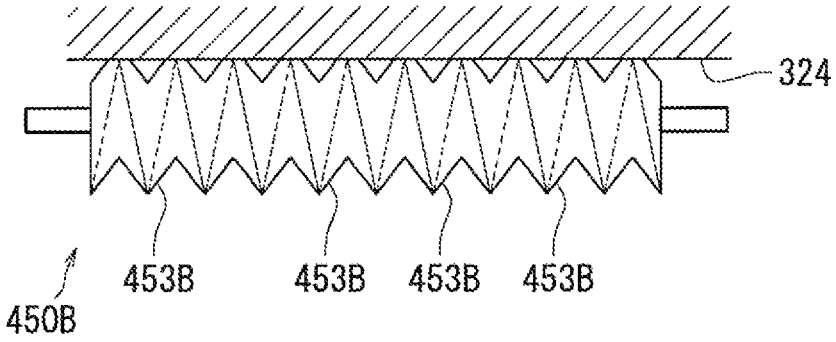
FIG. 4 is an illustration showing a liquid applying roller of an inkjet recording device according to the second variation in the second embodiment of the present disclosure.

The liquid applying roller 450 in the second embodiment has the cylindrical outer peripheral surface. However, as shown in FIGS. 3 and 4, the present disclosure is not limited to this. In other words, a liquid applying roller 450A shown in FIG. 3 or a liquid applying roller 450B shown in FIG. 4 may be provided in place of the liquid applying roller 450.

FIG. 3 shows the liquid applying roller 450A according to the first variation of the second embodiment. Elastic protrusions 453A are formed on the surface of the liquid applying roller 450A. Specifically, the liquid applying roller 450A includes a core bar 451A and a covering layer 452A. The core bar 451A is connected to a drive section (not shown) that drives to rotate the liquid applying roller 450A. The covering layer 452A covers the core bar 451A and rotates together with the core bar 451A. The covering layer 452A is made from rubber, for example. The covering layer 452A includes a plurality of annular protrusions 453A protruding around the circumferential surface of the liquid applying roller 450A. The protrusions 453A are arranged in a row in the axial direction of the liquid applying roller 450A. The protrusions taper in the radial direction (direction orthogonal to the axial direction) of the liquid applying roller 450A.

When the liquid amount adjusting section 420 is controlled to move the liquid applying roller 450A toward the conveyance belt 324, the tip ends of the elastic protrusions 453A are pressed against the conveyance belt 324 to be deformed. Accordingly, the contact area between the protrusions 453A and the conveyance belt 324 increases. This increases the amount of the liquid transferred from the liquid applying roller 450A to the conveyance belt 324. In reverse, when the liquid amount adjusting section 420 controls to move the liquid applying roller 450A away from the conveyance belt 324, the tip ends of the pressed protrusions 453A regain their original shape by the elasticity of their own. Accordingly, the contact area between the protrusions 453A and the conveyance belt 324 decreases. This decreases the amount of the liquid transferred from the liquid applying roller 450A to the conveyance belt 324. Thus, with the liquid applying roller 450A according to the first variation of the second embodiment, the amount of the liquid applied to the conveyance belt 324 can be adjusted easily.

FIG. 4 shows the liquid applying roller 450B according to the second variation of the second embodiment. Elastic protrusions 453B are formed on the surface of the liquid applying roller 450B. The liquid applying roller 450B has a configuration similar to that of the liquid applying roller 450A described with reference to FIG. 3 except that protrusions 453B are formed in a helical manner around the circumferential surface of the liquid applying roller 450B. With the liquid applying roller 450A according to the second variation of the second embodiment, the helically protruding protrusions 453B can apply the liquid uniformly to the support surface of the conveyance belt 324 when the liquid applying roller 450B rotates. The support surface means the surface of the conveyance belt 324 that comes into contact with the paper P.

The liquid amount adjusting section 420 is not essential in the inkjet recording device 1 in the second embodiment (including the first and second variations). For example, the liquid of which amount is set in advance may be applied to the conveyance belt 324 in a manner that the liquid applying roller 450 is fixed at a predetermined position to keep the contact area constant between the liquid applying roller 450 and the conveyance belt 324.

Third Embodiment

Figure 5:
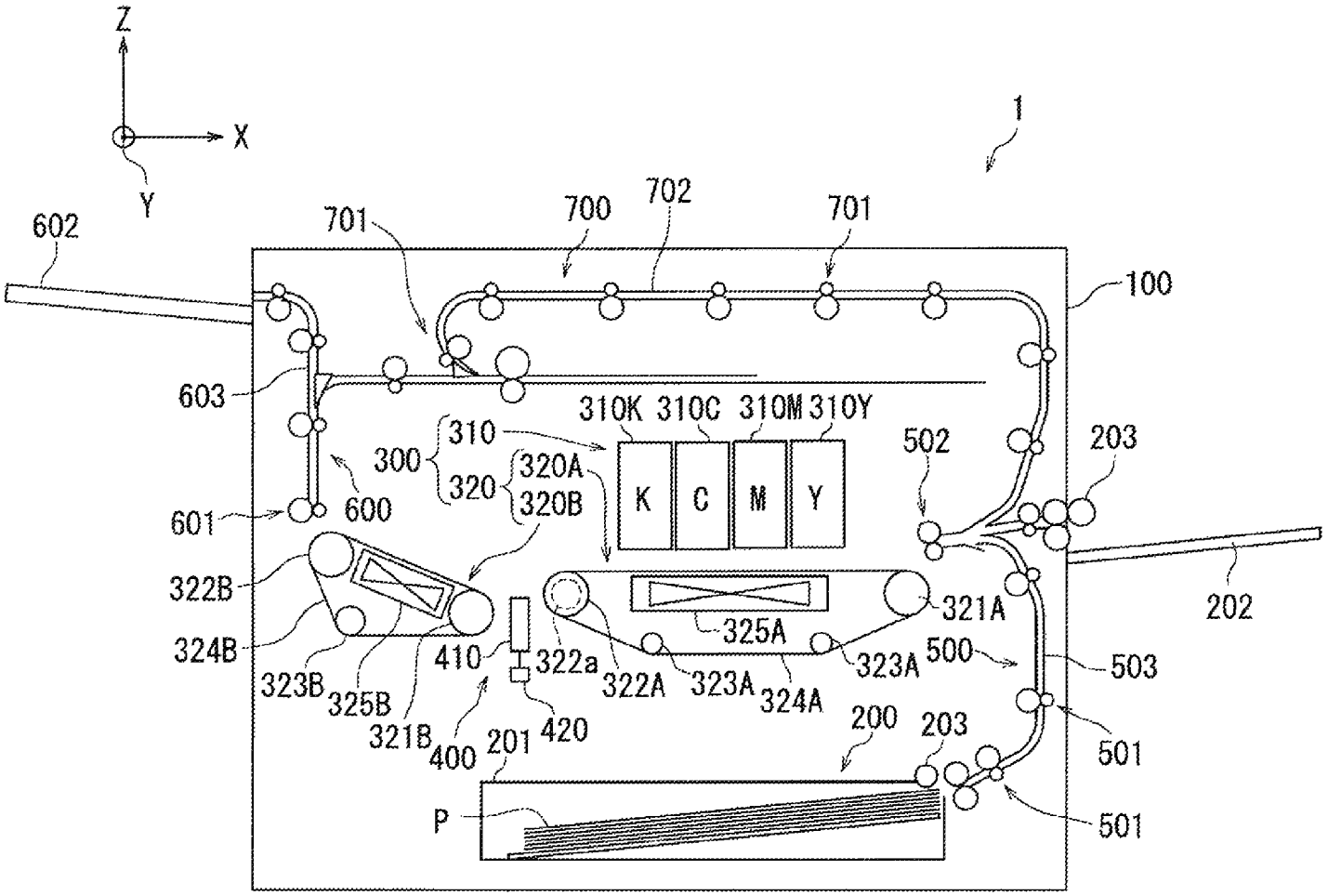
FIG. 5 is an illustration showing the configuration of an inkjet recording device according to the third embodiment of the present disclosure.

FIG. 5 shows the configuration of an inkjet recording device 1 according to the third embodiment of the present disclosure. The inkjet recording device 1 according to the third embodiment will be described below with reference to FIG. 5. The inkjet recording device 1 in the third embodiment has a configuration similar to that of the inkjet recording device 1 in the first embodiment described with reference to FIG. 1 except that the recording medium conveyance mechanism 320 includes a first conveyance section 320A and a second conveyance section 320B, and that the liquid applying section 400 is arranged in a different manner. Therefore, duplicate description will be omitted.

The first conveyance section 320A of the recording medium conveyance mechanism 320 is arranged to face the head portions 310 of the image forming section 300. The first conveyance section 320A includes a support roller 321A, a drive roller 322A, tension rollers 323A, a conveyance belt 324A, and a suction section 325A. The conveyance belt 324A receives the paper P from the carry-in conveyance section 500 and conveys it to the second conveyance section 320B. When the conveyance belt 324A conveys the paper P, the image forming section 300 forms an image on the first surface (surface P1) of the paper P. Respective elements of the first conveyance section 320A are the same as those of the recording medium conveyance mechanism 320 described with reference to FIG. 1. Therefore, detailed description will be omitted.

The second conveyance section 320B of the recording medium conveyance mechanism 320 is arranged downstream in the paper conveyance direction of the first conveyance section 320A. The second conveyance section 320B includes a support roller 321B, a drive roller 322B, a tension roller 323B, a conveyance belt 324B, and a suction section 325B. The conveyance belt 324B receives the paper P from the first conveyance section 320A and conveys it to the carry-out conveyance section 600. Respective elements of the second conveyance section 320B are the same as those of the recording medium conveyance mechanism 320 described with reference to FIG. 1. Therefore, detailed description will be omitted.

The liquid applying section 400 is arranged between the first and second conveyance sections 320A and 320B. The liquid applying section 400 applies the liquid to the second surface of the paper P being conveyed from the first conveyance section 320A to the second conveyance section 320B.

The inkjet recording device 1 according to the third embodiment has been described so far with reference to FIG. 5. In order to remove a jam or clean the head portions 310, the first conveyance section 320A is separated away from the image forming section 300 in the inkjet recording device 1 as necessary. According to the third embodiment, the recording medium conveyance mechanism 320 includes the separate first and second conveyance sections 320A and 320B. This enables only the first conveyance section 320A to be lifted up and down, thereby reducing a movable part of the inkjet recording device 1. Besides, the third embodiment can bring the same advantages as those in the first embodiment.

The liquid applying section 400 in the third embodiment is arranged between the first and second conveyance sections 320A and 320B, which however, should not be taken to limit the present disclosure. The liquid applying section 400 may be arranged downstream in the paper conveyance direction of the second conveyance section 320B.

In the first and third embodiments respectively described with reference to FIGS. 1 and 5, the liquid applying section 400 includes the ejection head portion 410 that applies the liquid to the second surface of the paper P directly. However, as shown in FIG. 6, this should not be taken to limit the present disclosure.

Fourth Embodiment

Figure 6:
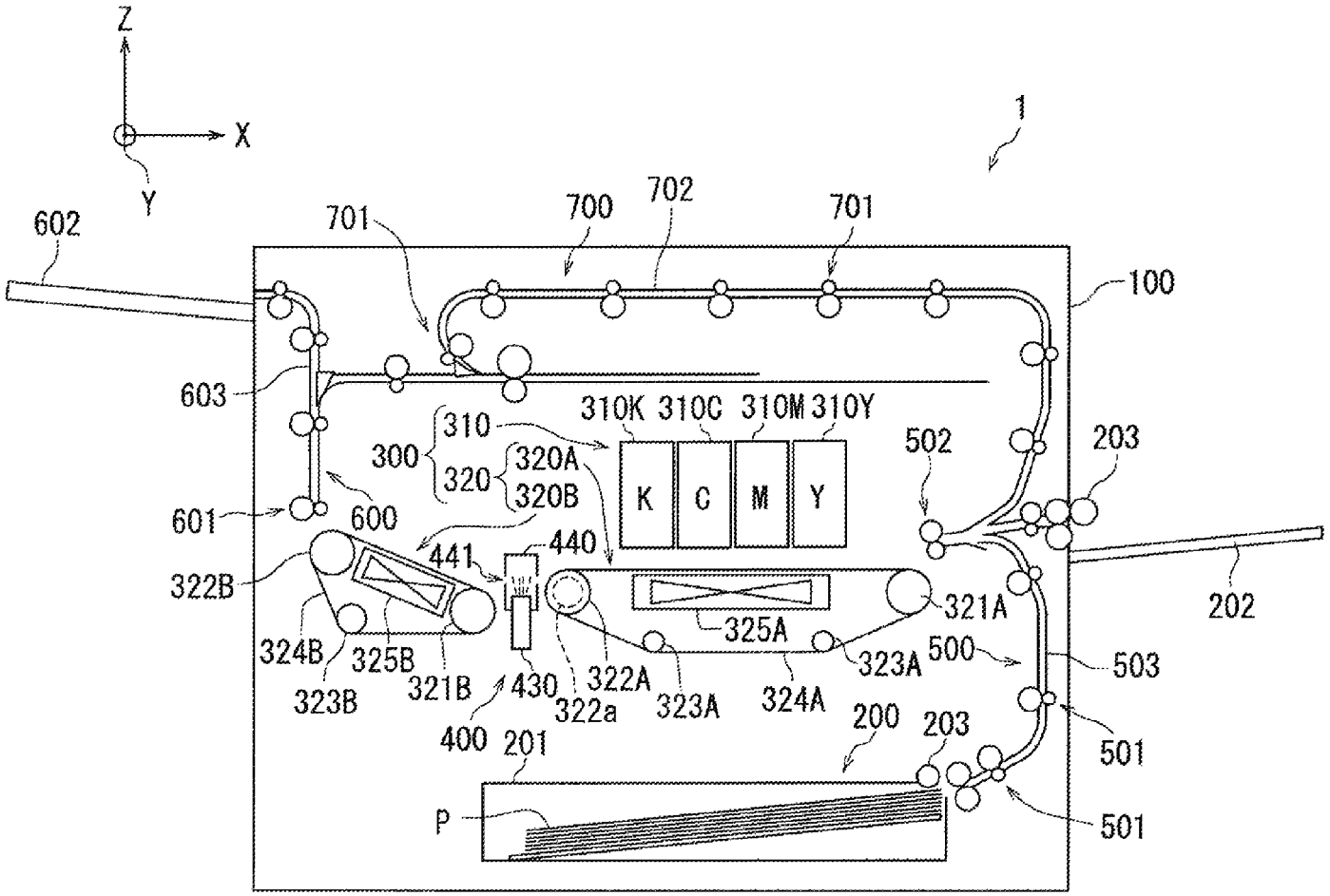
FIG. 6 is an illustration showing the configuration of an inkjet recording device according to the fourth embodiment of the present disclosure.

FIG. 6 shows the configuration of an inkjet recording device 1 according to the fourth embodiment of the present disclosure. The inkjet recording device 1 according to the fourth embodiment will be described below with reference to FIG. 6. The inkjet recording device 1 in the fourth embodiment has a configuration similar to that of the inkjet recording device 1 of the third embodiment described with reference to FIG. 5 except that the liquid applying section 400 includes an atomizer 430 in place of the ejection head portion 410 and the liquid amount adjusting section 420. Therefore, duplicate description will be omitted.

The atomizer 430 is arranged between the first and second conveyance sections 320A and 320B. The atomizer 430 jets atomized liquid to the second surface of the paper P. Any known configuration is employable for the atomizer 430. Therefore, detailed description and presentation of the figure are omitted.

In order to prevent the atomized liquid from flying inside the inkjet recording device 1, the liquid applying section 400 may further include an atomizer chamber 440. The atomizer chamber 440 is arranged between the first and second conveyance sections 320A and 320B. Openings 441 are formed in opposite side walls of the atomizer chamber 440 to allow the paper P to pass therethrough. The atomizer 430 jets the atomized liquid to the paper P passing through the atomizer chamber 440.

The inkjet recording device 1 according to the fourth embodiment has been described so far with reference to FIG. 6. According to the fourth embodiment, the atomized liquid is applied to the paper P, thereby promoting liquid penetration into the paper P. Accordingly, paper curling can be smoothed down further promptly. Besides, the fourth embodiment can bring the same advantages as those in the third embodiment.

The liquid applying section 400 in the fourth embodiment may further include the liquid amount adjusting section 420 also to adjust the amount of the liquid applied to the second surface of the paper P by the atomizer 430.

Fifth Embodiment

Figure 7:
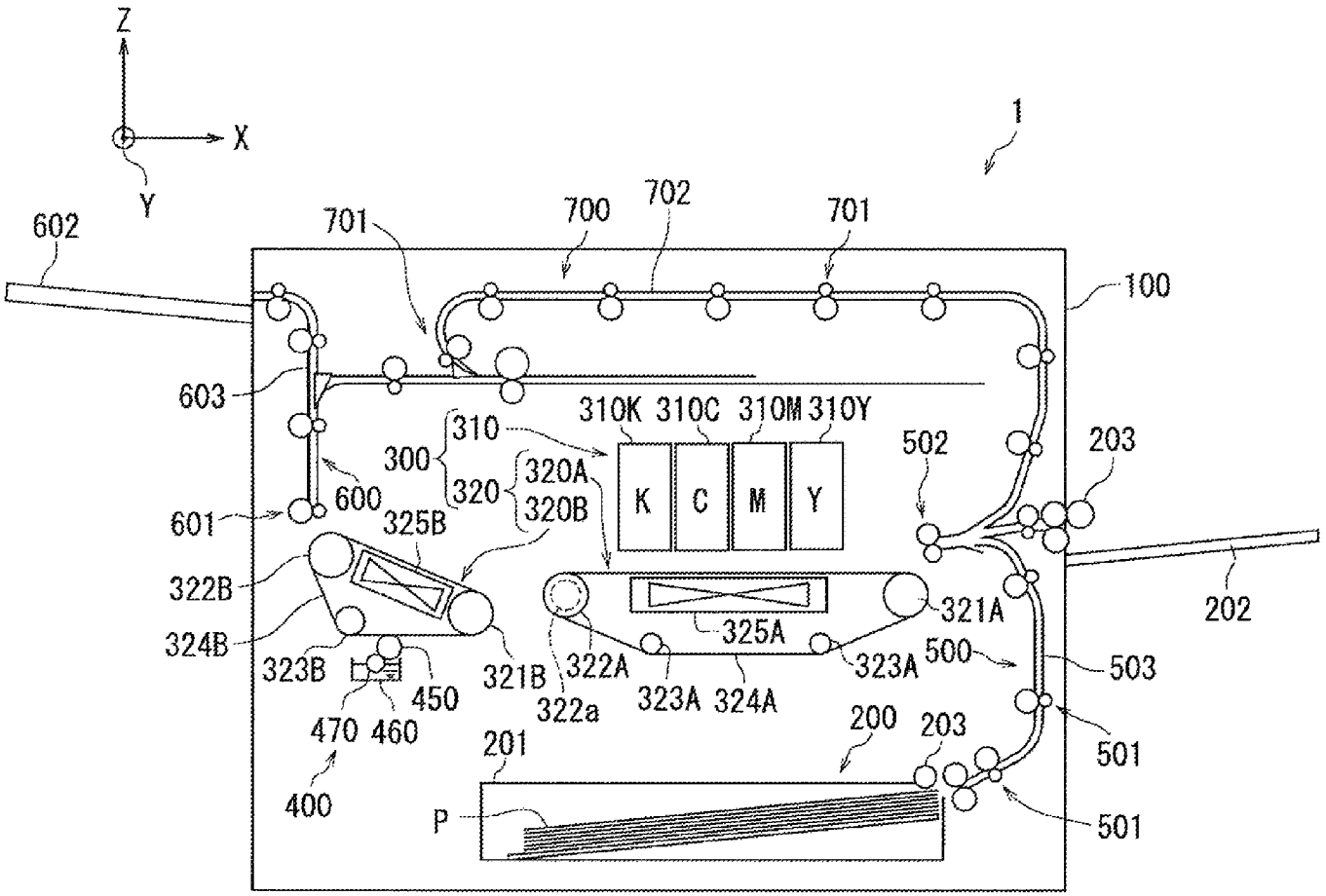
FIG. 7 is an illustration showing the configuration of an inkjet recording device according to the fifth embodiment of the present disclosure.

FIG. 7 shows the configuration of an inkjet recording device 1 according to the fifth embodiment of the present disclosure. The inkjet recording device 1 according to the fifth embodiment will be described below with reference to FIG. 7. The inkjet recording device 1 in the fifth embodiment has a configuration similar to that of the inkjet recording device 1 in the second embodiment described with reference to FIG. 2 except the arrangement of the liquid applying section 400. Therefore, duplicate description will be omitted.

The liquid applying section 400 in the fifth embodiment applies the liquid to the second conveyance section 320B. The liquid applying roller 450 of the liquid applying section 400 is arranged to be in press contact with the conveyance belt 324B of the second conveyance section 320B. The liquid applying section 400 includes a tank 460 to retain the liquid. A supply roller 470 is provided so that a part thereof is dipped in the liquid in the tank 460. The supply roller 470 rotates while supplying the liquid to the liquid applying roller 450 from the tank 460. The liquid supplied to the liquid applying roller 450 is applied to the conveyance belt 324B and then transferred to the second surface of the paper P conveyed on the conveyance belt 324B.

The inkjet recording device 1 according to the fifth embodiment has been described so far with reference to FIG. 7. In the fifth embodiment, the recording medium conveyance mechanism 320 includes the first and second conveyance sections 320A and 320B. This enables only the first conveyance section 320A to be lifted up and down, thereby reducing a movable part of the inkjet recording device 1. Further, in the fifth embodiment, the liquid is applied to the paper P via the second conveyance section 320B. Accordingly, like in the second embodiment, curling of the paper P can be reduced in simplex printing, and an image can be accurately formed on the paper P in duplex printing.

The liquid applying section 400 in the fifth embodiment described with reference to FIG. 7 applies the liquid to the second conveyance section 320B. However, as shown in FIG. 8, this should not be taken to limit the present disclosure.

Sixth Embodiment

Figure 8:
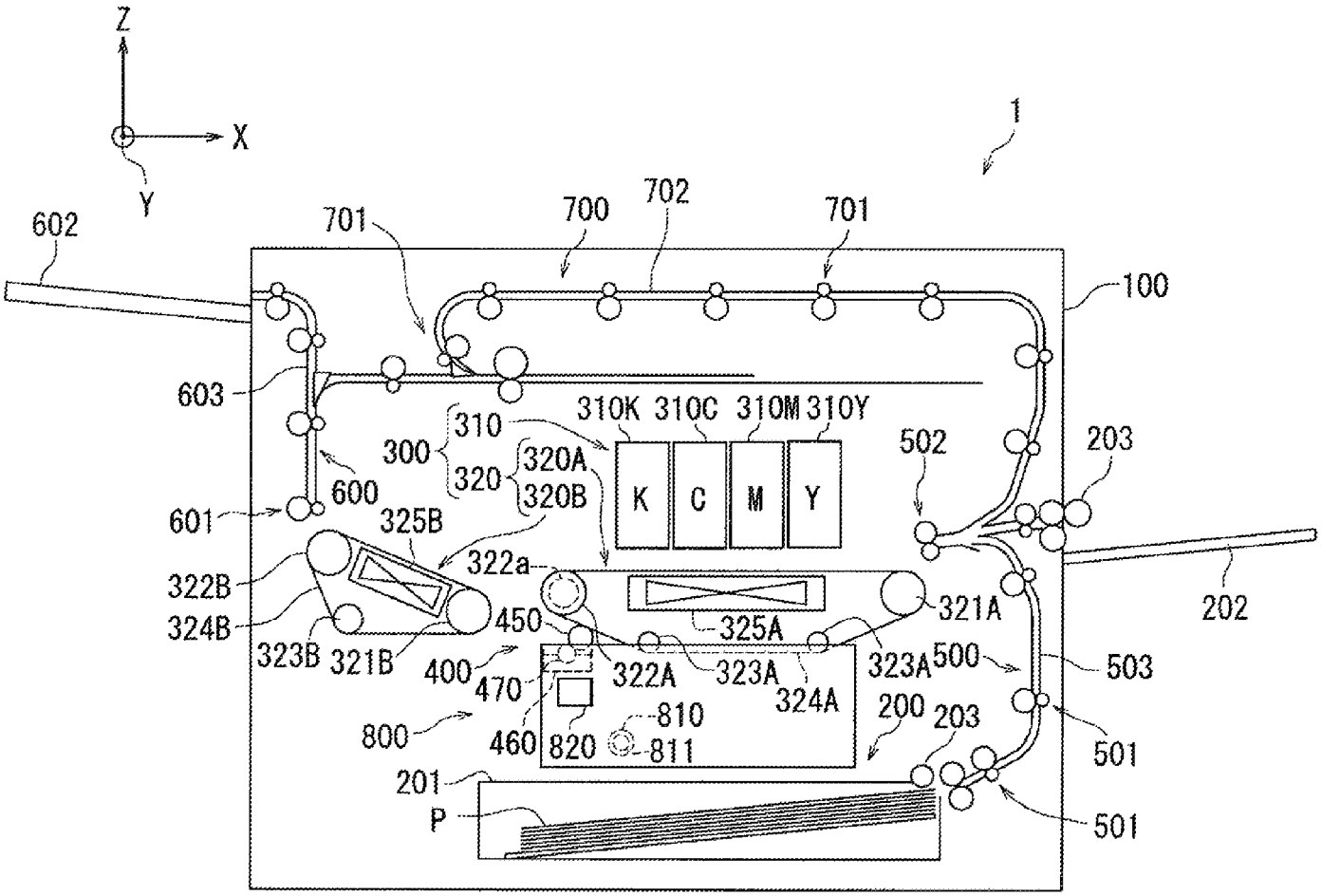
FIG. 8 is an illustration showing the configuration of an inkjet recording device according to the sixth embodiment of the present disclosure.

FIG. 8 shows the configuration of an inkjet recording device 1 according to the sixth embodiment of the present disclosure. The inkjet recording device 1 according to the sixth embodiment will be described below with reference to FIG. 8. The inkjet recording device 1 in the sixth embodiment has a configuration similar to that of the inkjet recording device 1 of the fifth embodiment described with reference to FIG. 7 except that the liquid is applied to the first conveyance section 320A and that a cleaning mechanism 800 is provided. Therefore, duplicate description will be omitted.

The first conveyance section 320A in the sixth embodiment includes the conveyance belt 324A. The liquid applying section 400 applies the liquid to the conveyance belt 324A. Specifically, the liquid applying roller 450 of the liquid applying section 400 is capable of being in press contact with the conveyance belt 324A of the first conveyance section 320A. The liquid supplied to the liquid applying roller 450 is applied to the conveyance belt 324A and then transferred to the second surface of the paper P conveyed on the conveyance belt 324A.

The cleaning mechanism 800 includes a lift (not shown), a lifting detecting section (not shown), a cleaning member 810, a rotary drive section 811, and a conveyance controller 820.

The lift lifts up and down the first conveyance section 320A. Specifically, the first conveyance section 320A is movable between an image formation position and a cleaning position. The image formation position is where the first conveyance section 320A forms an image on the first surface of the paper P. The cleaning position is where the first conveyance section 320A is lifted down from the image formation position to allow the conveyance belt 324A to come in press contact with the cleaning member 810. The lift lifts up and down the first conveyance section 320A between the image formation position and the cleaning position.

The cleaning member 810 is arranged below the first conveyance section 320A. The cleaning member 810 comes in press contact with the conveyance belt 324A of the first conveyance section 320A lifted down by the lift. The cleaning member 810 cleans the conveyance belt 324A. The cleaning member 810 in the sixth embodiment is a roller. The cleaning member 810 is rotatable in the same direction (arrowed direction D3 in FIG. 9A) as the first direction D1 (see FIG. 9A) and the same direction (arrowed direction D4 in FIG. 9A) as the second direction D2 (see FIG. 9B) by the rotary drive section 811 (e.g., a motor). The cleaning member 810 includes a material having high absorptivity. Examples of such a material include a porous body and a nonwoven fabric.

The lifting detecting section detects the position of the lift. The conveyance controller 820 is a microcomputer including a CPU, a ROM, and RAM. The CPU executes predetermined processing in accordance with programs stored in the ROM. The conveyance controller 820 controls the drive section 322*a* of the drive roller 322A and the rotary drive section 811 of the cleaning member 810 based on information output from the lifting detecting section.

Figure 9A:
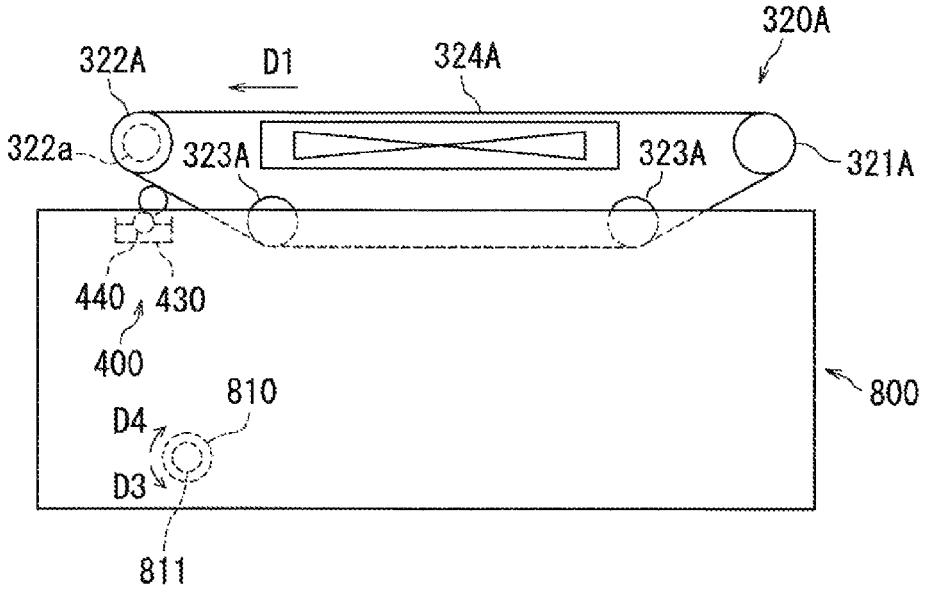
FIG. 9A shows a state in which a first conveyance section is positioned at an image formation position in the inkjet recording device according to the sixth embodiment of the present disclosure.
Figure 9B:
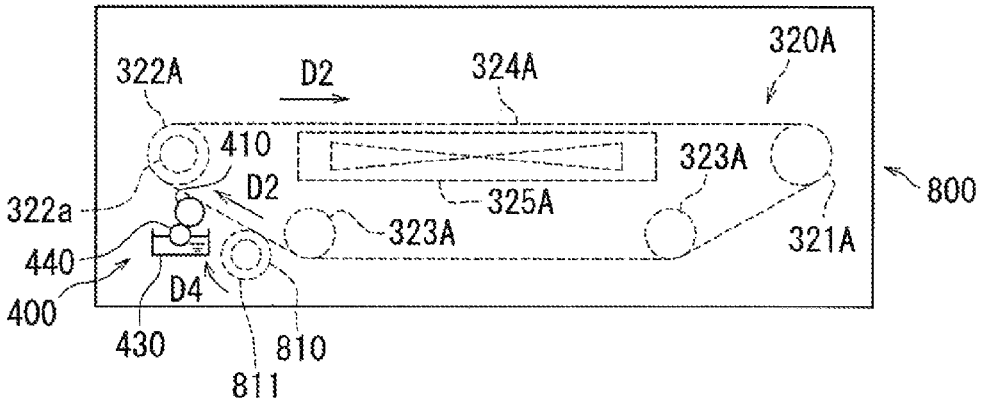
FIG. 9B shows a state in which the first conveyance section is positioned at a cleaning position in the inkjet recording device according to the sixth embodiment of the present disclosure.

An operation and effects of the sixth embodiment will be described next. FIGS. 9A and 9B show each operation of the first conveyance section 320A and the cleaning mechanism 800 in the sixth embodiment. FIG. 9A shows the state in which the first conveyance section 320A is positioned at the image formation position. FIG. 9B shows the state in which the first conveyance section 320A is positioned at the cleaning position.

In image formation, the head portions 310Y, 310M, 310C, and 310K eject the ink onto the first surface of the paper P. When the ink on the paper P is dried, the image is formed on the paper P. In image formation, the conveyance belt 324A is driven to rotate in the first direction D1.

In cleaning, when a belt cleaning start instruction is input through the operation panel (not shown), the lift of the cleaning mechanism 800 lifts down the first conveyance section 320A. Then, when the lifting detecting section detects the first conveyance section 320A at the belt cleaning position as shown in FIG. 9B, the lift stops.

As shown in FIG. 9B, the outer circumferential surface of the cleaning member 810 comes into press contact with the paper support surface of the conveyance belt 324A. The drive section 322*a* of the drive roller 322A drives to rotate the conveyance belt 324A in the second direction D2.

The drive roller 322A drives to rotate the conveyance belt 324A with a friction force generated between it and the conveyance belt 324A. Accordingly, when the conveyance belt 324A is driven to rotate in the second direction D2, a tension is applied to the conveyance belt 324A from the drive roller 322A to tense a part of the conveyance belt 324A on the upstream side in the second direction D2 of drive roller 322A.

As a result, the cleaning member 810 in press contact with the conveyance belt 324A receives a large reaction force from the conveyance belt 324A, thereby increasing the press contact force generated between the conveyance belt 324A and the cleaning member 810. Thus, a cleaning effect on the conveyance belt 324A can be enhanced.

The inkjet recording device 1 according to the sixth embodiment has been described so far with reference to FIGS. 8, 9A, and 9B. In the sixth embodiment, the conveyance belt 324A is separable from the cleaning member 810 and comes in press contact with the cleaning member 810 only in cleaning of the conveyance belt 324A. Accordingly, the cleaning member 810 does not interfere with the drive of the conveyance belt 324A in image formation. In other words, adverse influences by the cleaning member 810 in image formation can be reduced. Furthermore, separation of the cleaning member 810 from the conveyance belt 324A in image formation can reduce damage on the cleaning member 810, thereby enabling elongation of the lifetime of the cleaning member 810.

In cleaning the conveyance belt 324A, the cleaning member 810 is driven to rotate in the arrowed direction D4 that is the same as the second direction D2. A part of the cleaning member 810 that comes in contact with the conveyance belt 324A and a part of the conveyance belt 324A that comes in contact with the cleaning member 810 move in the opposite directions, thereby increasing each relative speed of the cleaning member 810 and the conveyance belt 324A. This can increase the friction force between the cleaning member 810 and the conveyance belt 324A. Thus, the cleaning effect on the conveyance belt 324A can be further enhanced.

Moreover, in the sixth embodiment, the liquid can be applied to the conveyance belt 324A also in cleaning of the conveyance belt 324A. By applying the liquid to the conveyance belt 324A, a portion of the ink attached to and solidified on the support surface of the conveyance belt 324A can be made soft and readily removed by absorbing the liquid. Thus, the cleaning effect on the conveyance belt 324A can be yet further enhanced.

Still further, in the inkjet recording device 1 of the sixth embodiment, the liquid is applied to the paper P via the first conveyance section 320A. Accordingly, curling of the paper P can be reduced in simplex printing, and an image can be formed accurately on the paper P in duplex printing, like in the fifth embodiment.

Yet further, the cleaning member 810 in the sixth embodiment comes in press contact with the conveyance belt 324A of the first conveyance section 320A lifted down to the cleaning position, which however, should not be taken to limit the present disclosure. The cleaning member 810 may be arranged so as to be in press contact with the conveyance belt 324A of the first conveyance section 320A positioned at the image formation position. Besides, the sixth embodiment can bring the same advantages as those in the fifth embodiment.

Seventh Embodiment

Figure 10:
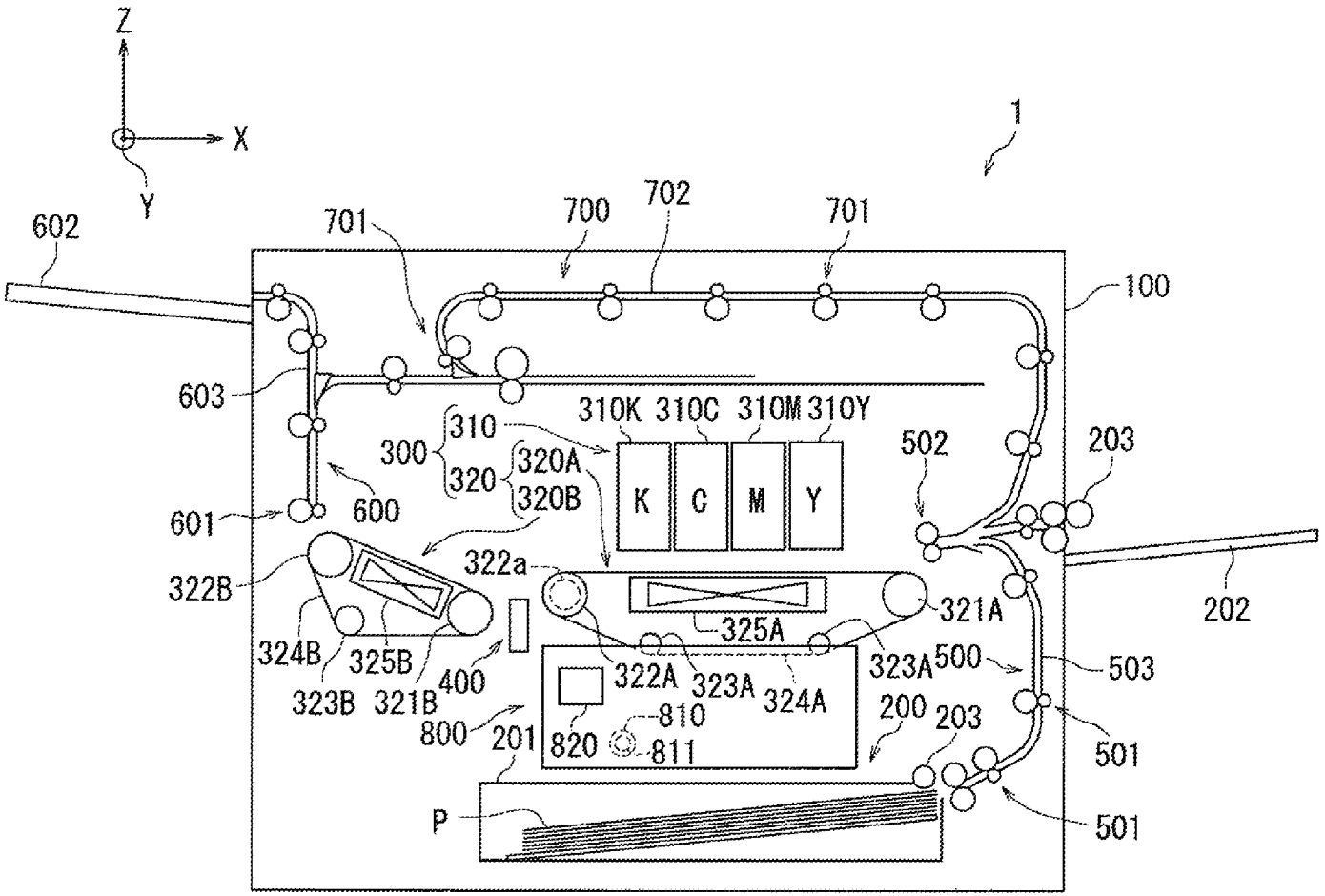
FIG. 10 is an illustration showing the configuration of an inkjet recording device according to the seventh embodiment of the present disclosure.

FIG. 10 shows the configuration of an inkjet recording device 1 according to the seventh embodiment of the present disclosure. The inkjet recording device 1 in the seventh embodiment has a configuration similar to that of the inkjet recording device 1 of the third embodiment described with reference to FIG. 5 except that a cleaning mechanism 800 is further included. Therefore, duplicate description will be omitted. Further, the cleaning mechanism 800 has the same configuration as the cleaning mechanism 800 of the inkjet recording device 1 in the sixth embodiment described with reference to FIG. 8. Therefore, description will be omitted.

Figure 11A:
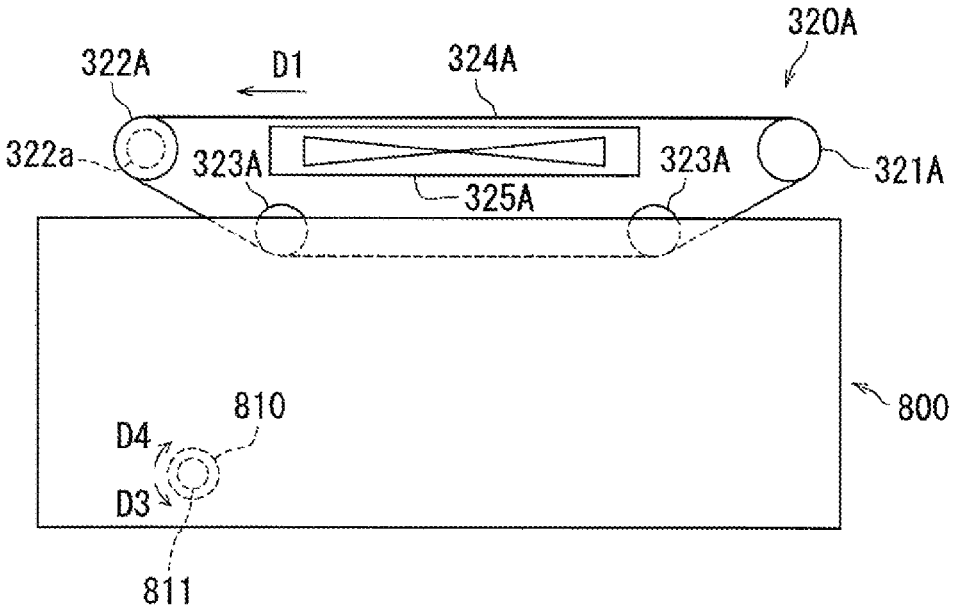
FIG. 11A shows a state in which a first conveyance section is positioned at the image formation position in the inkjet recording device according to the seventh embodiment of the present disclosure.
Figure 11B:
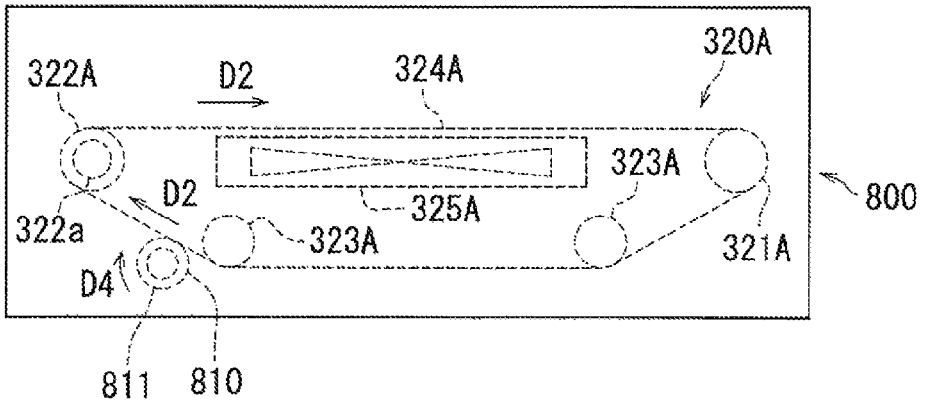
FIG. 11B shows a state in which the first conveyance section is positioned at the cleaning position in the inkjet recording device according to the seventh embodiment of the present disclosure.

FIGS. 11A and 11B show each operation of the first conveyance section 320A and the cleaning mechanism 800 in the seventh embodiment. FIG. 11A show the state in which the first conveyance section 320A is positioned at the image formation position. The operations of the first conveyance section 320A and the cleaning mechanism 800 in the seventh embodiment are the same as those of the first conveyance section 320A and the cleaning mechanism 800 described with reference to FIG. 9A, respectively. FIG. 11B show the state in which the first conveyance section 320A is positioned at the cleaning position. The operations of the first conveyance section 320A and the cleaning mechanism 800 in the seventh embodiment are the same as those of the first conveyance section 320A and the cleaning mechanism 800 described with reference to FIG. 9B, respectively. The inkjet recording device 1 according to the seventh embodiment has been described so far with reference to FIGS. 10, 11A, and 11B. According to the inkjet recording device 1 in the seventh embodiment, the cleaning member 810 does not interfere with the drive of the conveyance belt 324A in image formation. Accordingly, an adverse influence by the cleaning member 810 in image formation can be reduced.

Furthermore, in the inkjet recording device 1 in the seventh embodiment, curling of the paper P can be reduced in simplex printing, and an image can be formed accurately on the paper P in duplex printing, like in the third embodiment. Besides, the seventh embodiment can bring the same advantages as those in the third embodiment.

The liquid applied to the paper P or the recording medium conveyance mechanism 320 is water in the first to seventh embodiments described herein, which however, should not be taken to limit the present disclosure. The liquid may contain an additive in addition to water. Examples of the additive may be at least one type of preservatives, fungicides, and surfactants. For example, the liquid may be a transparent ink containing no pigment.

Furthermore, the first to seventh embodiment describe the case where the present disclosure is applied to an inkjet recording device that includes line head typed head portions 310 fixed to the device casing 100. However, the present disclosure is not limited to such an inkjet recording device. For example, the present disclosure is applicable to an inkjet recording device including recording heads movable relative to the device casing 100. In another example, the present disclosure may be applied to an inkjet recording device including serial type head portions.

The inkjet recording device in the present disclosure is suitable for image forming apparatuses such as printers, copiers, and multifunction peripherals, and information communication devices such as facsimiles. The inkjet recording device in the present disclosure can reduce curling of a recording medium.

What is claimed is:

1. An inkjet recording device comprising:

a recording medium conveyance mechanism configured to convey a recording medium;

a head portion having an ejection region to eject ink onto the recording medium; and a liquid applying section configured to apply a liquid to the recording medium, wherein the head portion includes a plurality of nozzles, the ink is ejected onto the recording medium selectively from the nozzles in the ejection region to form an image on the recording medium, the liquid applying section does not eject and jet liquid to the recording medium at a location upstream of the ejection region in a conveyance direction in which the recording medium is conveyed, and the liquid applying section ejects or jets liquid directly to the recording medium at a location downstream of the ejection region in the conveyance direction, the liquid applying section ejects or jets the liquid to the recording medium conveyance mechanism through adjustment of a direction in which the liquid is ejected or jetted, and the liquid applying section ejects or jets the liquid to the recording medium conveyance mechanism and directly to the recording medium through further adjustment of the direction in which the liquid is ejected or jetted.

2. An inkjet recording device according to claim 1, wherein the recording medium has a first surface and a second surface, the head portion ejects the ink onto the first surface of the recording medium, and the liquid applying section ejects or jets the liquid directly to the second surface of the recording medium while ejecting or jetting no liquid to the first surface of the recording medium.

3. An inkjet recording device according to claim 2, wherein the recording medium conveyance mechanism includes a first conveyance section and a second conveyance section, and the first conveyance section faces the head portion.

4. An inkjet recording device according to claim 3, wherein the liquid applying section is arranged between the first and second conveyance sections, and the liquid is ejected or jetted to the second surface of the recording medium conveyed from the first conveyance section to the second conveyance section.

5. An inkjet recording device according to claim 2, wherein the liquid applying section includes an ejection head portion or an atomizer.

6. An inkjet recording device according to claim 5, wherein the liquid applying section further includes a liquid amount adjusting section configured to adjust according to an amount of ink ejected onto the first surface of the recording medium, an amount of the liquid that the ejection head portion or the atomizer ejects or jets to the second surface of the recording medium.

7. An inkjet recording device according to claim 3, further comprising:

a cleaning mechanism including a cleaning member, the first conveyance section includes a conveyance belt, and the cleaning member is in press contact with the conveyance belt of the first conveyance section to clean the conveyance belt.

8. An inkjet recording device according to claim 7, wherein the first conveyance section further includes a drive section configured to rotate the conveyance belt in a first direction and a second direction opposite to the first direction, the cleaning mechanism further includes a conveyance controller configured to control the drive section, the cleaning member is in press contact with the conveyance belt of the first conveyance section on a downstream side in the first direction of the drive section, and the conveyance controller controls the drive section to drive to rotate the conveyance belt in the second direction when the cleaning member cleans the conveyance belt.

9. An inkjet recording device according to claim 7, wherein the cleaning mechanism further includes a lift configured to lift up and down the first conveyance section, and the cleaning member comes in press contact with the conveyance belt of the first conveyance section lifted down by the lift.

10. An inkjet recording device according to claim 1, wherein the liquid applying section ejects or jets the liquid to the recording medium via the recording medium conveyance mechanism.

11. An inkjet recording device according to claim 1, wherein the liquid contains water.

12. An inkjet recording device according to claim 1, wherein the liquid contains at least one type of preservatives, fungicides, and surfactant.

13. An inkjet recording device according to claim 1, wherein the liquid applying section is inclined in the conveyance direction.

14. An inkjet recording device according to claim 1, wherein the recording medium conveyance mechanism includes:

a plurality of rollers;

a conveyance belt wound around the plurality of rollers; and a suction section, the recording medium is placed on the conveyance belt, the suction section sucks the recording medium onto the conveyance belt, and in a situation in which the liquid applying section effects or jets the liquid to the recording medium conveyance mechanism, the liquid applying section ejects or jets the liquid to the conveyance section.

* * * * *